United States Patent [19]

Wade

[11] 4,404,796

[45] Sep. 20, 1983

[54] REMOVAL OF PARTICULATES FROM DIESEL ENGINE EXHAUST GAS

[75] Inventor: Wallace R. Wade, Farmington Hills, Mich.

[73] Assignee: Ford Motor Company, Dearborn, Mich.

[21] Appl. No.: 384,806

[22] Filed: Jun. 3, 1982

[51] Int. Cl.[3] ..... F01N 3/02

[52] U.S. Cl. ..... 60/274; 60/286; 60/288; 60/303; 60/311

[58] Field of Search ..... 60/274, 286, 288, 303, 60/311; 123/198 F

[56] References Cited

U.S. PATENT DOCUMENTS

| | | | |
|---|---|---|---|
| 4,107,921 | 8/1978 | Iizuka | 60/288 |
| 4,167,852 | 9/1979 | Ludecke | 60/311 |
| 4,211,075 | 7/1980 | Ludecke | 60/285 |
| 4,331,454 | 5/1982 | Sweeney | 60/274 |
| 4,372,111 | 2/1983 | Virk | 60/311 |

*Primary Examiner*—Douglas Hart

*Attorney, Agent, or Firm*—Joseph W. Malleck; Olin B. Johnson

[57] ABSTRACT

A method and apparatus is disclosed for periodically oxidizing particulate matter trapped in and on an exhaust gas purifying device used in conjunction with a diesel engine. Fuel normally delivered to selected combustion chambers is diverted to a fuel burning device associated with the purifying device. The diversion deactivates the combustion process in the selected chambers. The diverted fuel is then burned by the burning device to increase the exhaust gas temperature flowing through the purifying device and effect oxidation of collected particles.

17 Claims, 3 Drawing Figures

REMOVAL OF PARTICULATES FROM DIESEL ENGINE EXHAUST GAS

BACKGROUND OF THE INVENTION AND PRIOR ART STATEMENT

The control of particulate emissions from diesel engines is one of the major technical issues facing the automotive industry if diesel engines are to be used in light duty vehicles. Some form of exhaust treatment will be necessary to meet the above regulations. Such exhaust treatment is typically envisioned to consist of a filter or trap to collect the particulates in the exhaust, together with a method for periodically disposing of the collected particulates. The system is commonly called a trap oxidizer. Periodic disposal of particulates is necessary because as the particulates collect on the trap the exhaust back pressure increases and adversely affects fuel economy and vehicle performance. Particulates can collect in amounts of up to about 75 gallons over a period of 50,000 miles of vehicle operation for a conventional vehicle diesel engine.

To initiate particulate oxidation the exhaust gas temperature must be at a very elevated level. Unfortunately in typical diesel powered passenger cars the exhaust gas temperature usually does not attain a high level until speeds above 70 mph are reached. Therefore supplementary means has appeared necessary to the prior art to achieve oxidation of such particulates.

Attempts by the prior art to provide for particulate oxidation have included the idea of using a separately fueled burner stationed in the particulate trap and which is selectively controlled to raise the inlet temperature of the trap to a desired temperature for regeneration (the latter is a term that is used to identify the oxidation and removal of the particles).

One technique is to initiate trap regeneration by using the exhaust gas from the diesel engine to produce the required temperature and oxygen concentration. One example of this is shown in U.S. Pat. No. 3,800,772, which shuts off fuel to certain combustion cylinders of the diesel engine, allowing the inducted air to continue through such fuel starved cylinders to become part of the exhaust gas. In U.S. Pat. No. 4,211,075, fuel as well as air is stopped from entering certain selected combustion chambers with the hope that the remaining combustion chambers will cause an increase in temperature in the exhaust gas sufficient to provide for regeneration. However, diesel engines, particularly those of the indirect injection type, have high compression/expansion ratios of over 20:1 and operate unthrottled with lean air/fuel ratios. Thus shutting off certain of the cylinders with fuel or air, or both, is inadequate to initiate the proper degree of regeneration at most speed and loading conditions encountered in normal driving. Certain operating conditions can achieve the desired regeneration, but these conditions are usually achieved only under special circumstances. Thus high speed/high load regeneration is not practical for normal vehicle operation and certainly not for steady state conditions. Furthermore, throttling generally has an adverse effect on the engine exhaust emissions and fuel consumption.

To solve the problems associated with throttling, the prior art has stationed a burner at the upstream portion of the trap, which is separately fueled for creating the proper temperature environment for regeneration. The burner can be supplied with air from an external pump or the total amount of exhaust gas from the entire engine can be used as the supplier of the excess oxygen needed for combustion in the particulate trap. In either case the externally fueled burner is supplied with combustible fuel which is sprayed through an atomizing nozzle and then ignited by a glow plug or spark plug.

A disadvantage to utilizing an air fed burner regeneration system is that considerable complexity is added to the engine to provide for an engine driven air pump. In addition, the stability of the regeneration operation is in question for engine speeds above 55 mph. An exhaust supplied burner regeneration system produces somewhat higher hydrocarbon emissions. With each of these systems the consumption of additional fuel beyond that required for normal engine operation is excessive, requiring 2.5 to 5% of the fuel required for normal engine operation over the federal CVS driving cycle.

SUMMARY OF THE INVENTION

The invention relates to diesel engine exhaust gas treatment and in particular to a method and apparatus for periodically oxidizing particulate matter trapped in and on an exhaust gas purifying device used in conjunction with a diesel engine having a pluraity of combustion cylinders, each supplied with fuel for combustion. The purifying device has a fuel burning device associated therewith. The method comprises the steps of: (a) diverting fuel normally delivered to selected combustion cylinders of the diesel engine to the fuel burning device associated with the purifying device, the diversion deactivating the combustion process of the selected cylinders; and (b) burning only the diverted fuel by the fuel burning device to increase the exhaust gas temperature flowing through the purifying device to a temperature effective to combust the trapped particulate matter.

The burning step is preferably carried out by use of a burning device having a fuel injector effective to spray diverted fuel into the purifying device and having ignition means, such as a heated screen, effective to ignite the mixture of sprayed fuel and exhaust gas in proximity to the trapped particulate matter. The burning step is preferably carried out to increase the exhaust gas temperature to a level in excess of 1000° F. (537.78° C.).

Advantageously, the number of selected cylinders for deactivation can be one-half the total number of cylinders and the exhaust (cold air) from the selected deactivated cylinders should desirably be bypassed around the purifying device.

The trap preferably is comprised of microporous ceramic honeycomb material having aligned channels with alternate parallel channels thereof blocked to force flow of the exhaust gases through the micropores of the material while trapping particulate material. The spacing between the channels is preferably in the range of 0.09–0.11 inches and the thickness of the walls defining the channels is preferably in the range of 0.012–0.017 inches.

The diverting step is preferably carried out by use of a variable pressure check valve, the operating pressure of which is selectively changed to effect the diversion. The diversion can be carried out for periods of 2–5 minutes to effect combustion and regeneration of the trap. Mileage intervals between regeneration can be 50–150 miles.

The apparatus of this invention comprises the combination of a diesel engine, an exhaust system, and an exhaust gas purifying system. The purifying system comprises: (a) an exhaust gas filter means having a particulate trap and a fuel injector for introducing fuel to the entrance of the trap, (b) fuel supply means effective to provide a pressurized supply of fuel to each of the combustion chambers of the engine and to alternately supply fuel to the injector of the filtering means, (c) diverter means having at least one valve selectively operable to divert the supply of fuel from certain of the combustion chambers to the fuel injector of the filtering means, and (d) means for igniting said diverted fuel when injected into said filter by said filter fuel injector.

Preferably, the injector for the filter means operates to open in response to a first pressure, and the one valve of the diverter means is selectively operable to open in response to a pressure lower than the first pressure. A tapered rod may advantageously be employed to vary the opening pressure on the valve, the latter preferably being a spring loaded check valve. The trap may desirably have a diverging interior entrance wall to facilitate ignition.

DETAILED DESCRIPTION

Figure 1:
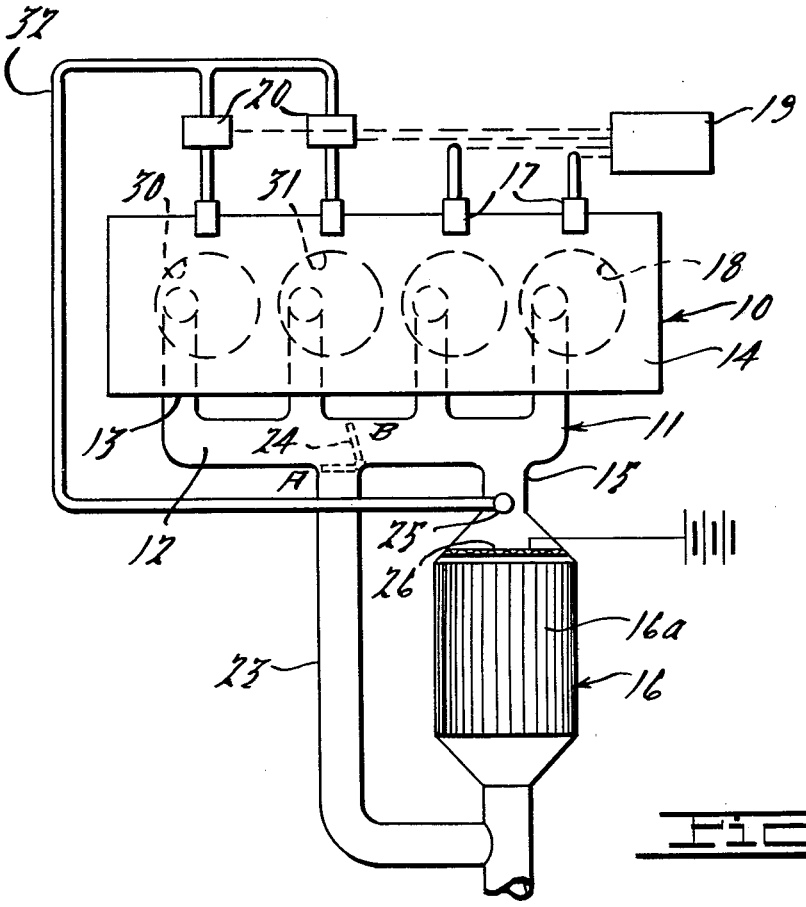
FIG. 1 is a schematic illustration of a diesel engine controllably operated by a fuel control system and having a emission control system embodying the principles of this invention.

Referring now to the drawings in detail, FIG. 1 illustrates a preferred apparatus for the invention herein, the apparatus is useful in an automotive vehicle having a conventional diesel engine 10 with an air induction system (not shown), and a fuel supply means having fuel injectors 17 associated with each of the combustion chambers or cylinders 18. A fuel control 19, including deactivation valve means 20, provides for the controllable supply of fuel to the combustion chambers. The engine also has an exhaust system 11, including an exhaust manifold 12, connecting with individual exhaust ports 13 along one side of an engine cylinder head 14. The exhaust manifold 12 feeds into an exhaust pipe 15 in which there is mounted a purifying device or particulate trap 16 containing filter means having at least one filter element **16*a* through which the exhaust gases from the engine are required to pass. Exhaust gases from the deactivated combustion chambers are bypassed about the particulate trap by way of conduit 23 controlled by valve 24. The particles trapped in device 16 are periodically combusted by the elevated exhaust temperature created by the remaining firing cylinders, which run hotter, and by the burning of fuel diverted by means 20 and 32 to the burner device 25**.

The purifying device 16 may be made of any suitable material and any configuration capable of trapping and holding substantial quantities of particulates from the engine exhaust gases without creating an excessive restriction to exhaust gas flow. The device must be able to withstand the elevated temperatures reached in the subsequent combustion of trapped particulates during engine operation. Examples of structures which may be suitable for such purpose include ceramic beads, monolithic ceramic structures, metal wire mesh, or multiple stainless steel screen elements.

It is preferred that the exhaust gas filter means (filter element **16*a***) be formed of a microporous ceramic honeycomb substrate which has a plurality of aligned channels, alternate channels being closed or plugged, forcing the gases to flow through the walls of the honeycomb structure. The ceramic has about 100 cells per square inch in the walls of such substrate. The thickness of the walls is controlled to about 0.012–0.017 inches, with the spacing between the walls being about 0.09–0.11 inches. This type of honeycomb trap provides a very high filtration surface area per unit of volume, which can be about 16.6/in.$^3$.

The particulate matter is filtered or trapped by the mechanical mechanisms of interception and diffusion. The ceramic particulate trap can effectively collect about 50–70% of the particulate emissions from a diesel engine. However, for 50,000 miles of operation, such trap would have to collect a volume of particulates that is over 100 times the volume of the trap itself. Therefore, a periodic regeneration system is required to combust or oxidize the collected particulate matter.

Figure 3:
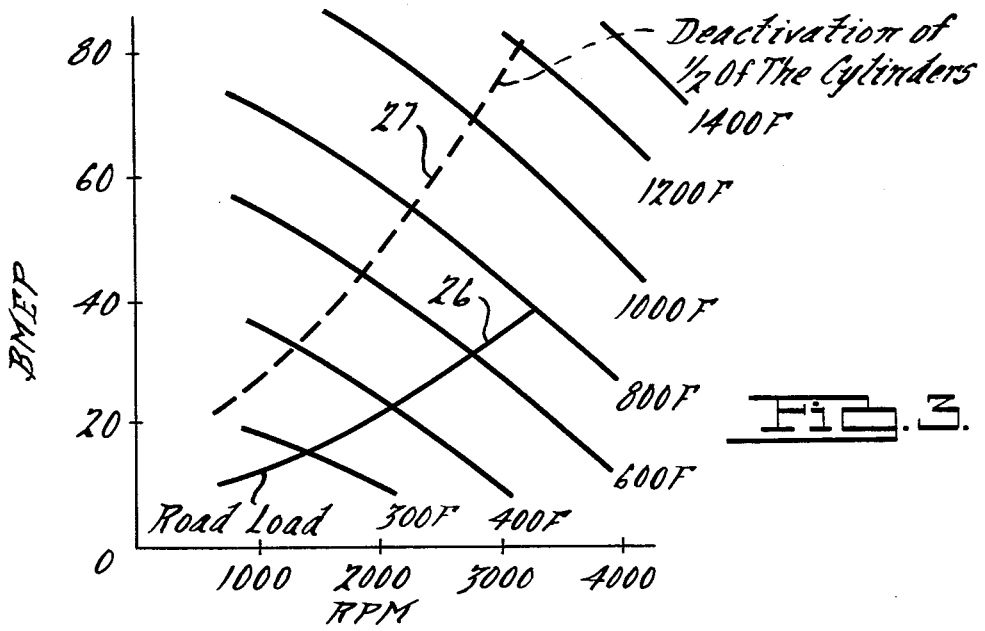
FIG. 3 is a graphical illustration of exhaust temperature generated by the diesel engine as a function of crankshaft speed (RPM) and BMEP.

In accordance with this invention, the particulates can be oxidized in the presence of excess oxygen if the temperature is raised above 1000° F. Unfortunately, the exhaust temperature of a diesel engine does not reach 1000° F. until very high engine speeds are attained, as shown by plot 26 in FIG. 3. Normal road load exhaust temperatures are below 800° F. so that the regeneration cannot occur during these conditions. Since the diesel engine operates at lean air/fuel ratios, excess oxygen in varying quantities, depending upon engine speed and load, is always available in the exhaust gas. Therefore, the exhaust gas of the diesel engine can be used as an oxygen supply for combustion of trapped particles, but some form of fuel is needed for the burner 25. The method of this invention employs fuel diverted from certain of the deactivated combustion chambers.

In accordance with this invention, a preferred method for periodically oxidizing particulate matter trapped in and on an exhaust gas purifying device used in conjunction with a diesel engine having a plurality of combustion cylinders, comprises the following steps: (a) diverting fuel normally delivered to selected combustion cylinders (30–31) of the diesel engine 10 to the fuel burning device 25 (deactivation valves 20 send the diverted fuel through fuel line 32) and thereby deactivate the combustion operation of said selected cylinders (30–31), and (b) buring only the diverted fuel by the fuel burning device 25 to increase the exhaust gas temperature flowing through the purifying device 16 to a temperature effective to combust the trapped particulate matter.

Figure 2:
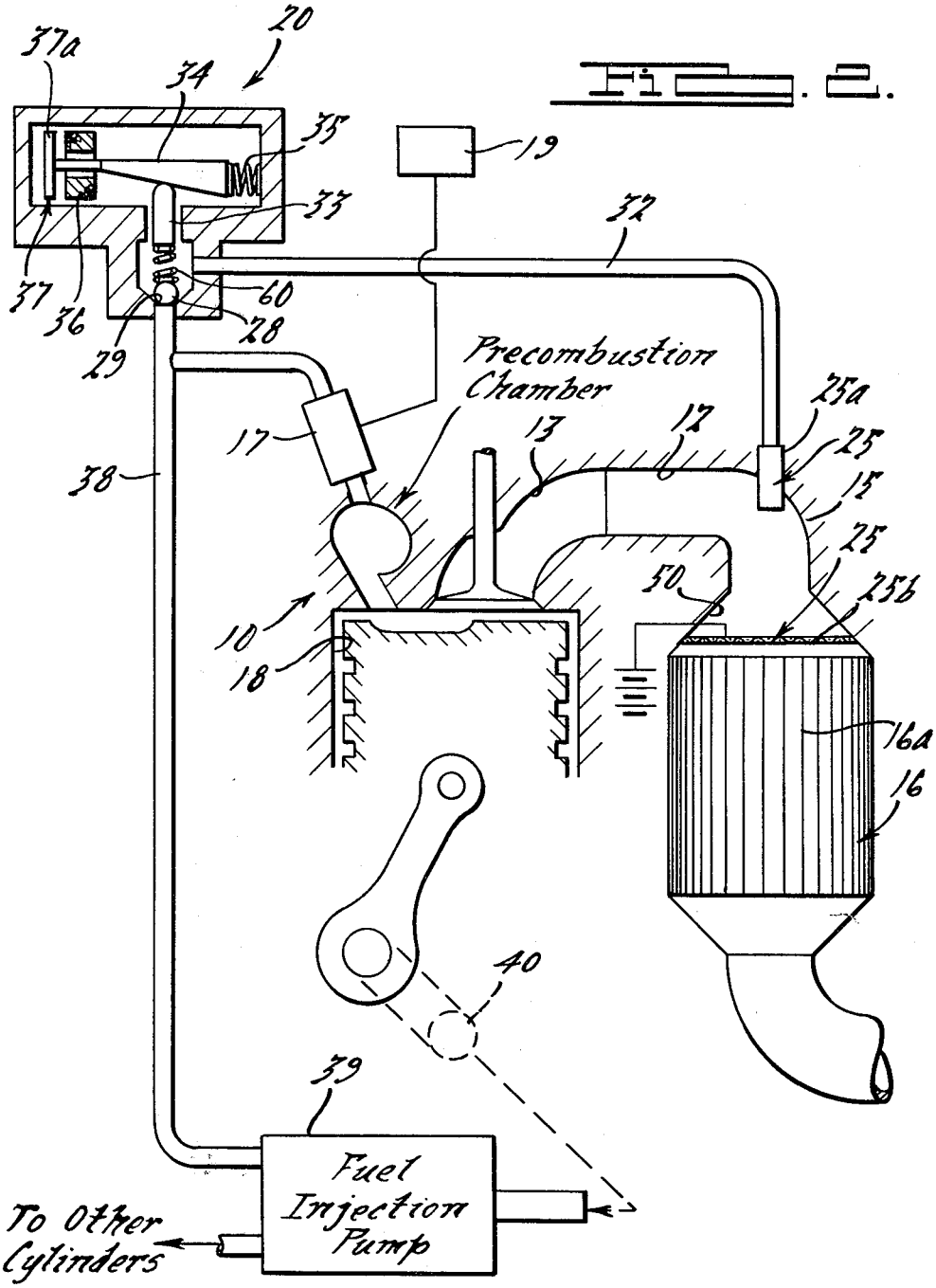
FIG. 2 is an enlarged schematic illustration of the emission control system of this invention showing only one of the combustion chambers that is to be deactivated.

In such method the following two features raise the temperature of the exhaust gas to a temperature in excess of 1000° F. (537.78° C.) and particle oxidation will occur:

1. By deactivating some (preferably half) of the engine combustion cylinders, the exhaust gas temperature from the firing cylinders will be approximately equal to that shown for plot 27 in FIG. 3 at BMEP levels that are twice those at the normal road load (plot 26). Even higher temperatures are achieved by the use of fuel diversion. Fuel diversion can be carried out by use of a solenoid actuated deactivation valve 20 in the form of a variable preload or variable opening pressure check valve, as shown particularly in FIG. 2. The valve has a ball element 28 normally closing diverting port 29, as urged by preload spring 32. Variation in the preloading force is selectively provided by movement of stop element 33 by way of a tapered rod 34. The tapered rod 34 is normally urged to a left position by spring 35, causing stop element 33 to promote a high opening pressure preventing diversion. The opening pressure of valve 20 will then be significantly above the opening pressure for fuel injector 25, associated with the fuel burner, so that normal engine operation will take place. Solenoid 37 is provided to selectively overcome spring 35 upon energization of winding 36 to draw plate 37*a* to the right, moving rod 34 to the right, and thereby permit a lower opening pressure on element 28. In the position as shown, the tapered rod has been moved to a position allowing stop element 33 to rise and open the valve 20, since the fuel pressure in line 38 from the fuel injector pump 39 (driven by the engine crankshaft 40) will be in excess of the lowered spring force of 32. Fuel will flow to the trap injector 25 which has a valve opening pressure significantly lower than the engine injection nozzle valve 17.

2. The burner device 25 will add further energy units to the increased temperature of the exhaust gas. The burner device has a fuel injector 25*a* effective to spray atomized fuel into the inlet to the particulate trap 16 and an ignition screen 25*b*. The atomized diverted fuel is mixed with the exhaust gas, sprayed into the entrance of the trap, which may preferably have a diverging wall 50, and is then ignited by the electrical resistance heated ignition screen 25*b* (part of burner device). The collected particles are oxidized by an exothermic reaction which provides an additional temperature rise in the exhaust gas to assure continuation of regeneration until fuel diversion is stopped. The regeneration is preferably continued for a period of 1–5 minutes to effect complete combustion. Intervals between regeneration can be 30–150 miles.

It is desirable that flow of air through the deactivated cylinders be continued, but that such flow be prevented from entering the purifying device and thereby be prevented from affecting regeneration. Bypass valve 24, downstream of the cylinders, is used to shut off the flow of air from the deactivated cylinders, as shown in FIG. 1. The valve can be selectively moved between a position "A", which allows all of the exhaust gas to flow into the particulate trap, and to a position "B", where flow of the two deactivated cylinders is blocked.

I claim:

1. A method for periodically oxidizing particulate matter trapped in and on an exhaust gas purifying device used in conjunction with a diesel engine having a plurality of combustion cylinders, each supplied with fuel for combustion, said purifying device having a fuel burning device associated therewith, the method comprising the steps of:

(a) diverting fuel normally delivered to selected combustion cylinders of said diesel engine to said fuel burning device and thereby deactivate the combustion operation of said selected cylinders;

(b) burning only said diverted fuel by said fuel burning device to increase the temperature of the exhaust gas from the nonselected cylinders flowing through said purfiying device to a level effective to combust said trapped particulate matter.

2. The method as in claim 1, in which said fuel burning device comprises a fuel injector effective to spray diverted fuel into said purifying device, and ignition means effective to ignite the mixture of said sprayed fuel and exhaust gas in proximity to said trapped particulate matter.

3. The method as in claim 1, in which the exhaust gas flowing from said selected and deactivated combustion cylinders is bypassed around said exhaust gas purifying device.

4. The method as in claim 1, in which said selected cylinders for deactivation comprise 50% or less of said plurality of cylinders.

5. The method as in claim 1, in which step (b) is carried out to increase the exhaust gas temperature flowing through said purifying device to a temperature level in excess of 1000° F. (537.78° C.).

6. The method as in claim 1, in which diverting is carried out by the use of a variable pressure check valve, the operating pressure on said check valve being changed selectively to effect said diversion.

7. The method as in claim 2, in which said ignition means comprises a heated screen adjacent the entrance to said purifying device.

8. The method as in claim 1, in which half of said plurality of combustion cylinders are deactivated in step (a).

9. The method as in claim 1, in which said purifying device comprises a trap constituted of a microporous ceramic honeycomb material having aligned channels with alternate parallel channels thereof blocked to force flow of said exhaust gases through the micropores of said honeycomb material while trapping particulate matter.

10. The method as in claim 9, in which the spacing between said channels is in the range of 0.09–0.11 inches, and the thickness of walls defining said channels is in the range of 0.012–0.017 inches.

11. The method as in claim 1, in which said diverting and burning is carried out for a continuous period of about 2–5 minutes to effect the combustion of said particulate matter.

12. In the apparatus combination of a diesel engine, an exhaust system, and exhaust gas purifying system, the improvement comprising a purifying system having:

(a) an exhaust gas filter means having a particulate trap and a filter fuel injector for introducing fuel to the trap;

(b) fuel supply means effective to provide a pressurized supply of fuel to fuel injectors for each of the cylinders of said diesel engine and alternatively to said filter fuel injector;

(c) diverter means having at least one valve selectively operable to divert said pressurized supply of fuel from certain of said cylinders to the filter fuel injector; and (d) means for igniting said diverted fuel when injected into said filter by said filter fuel injector.

13. The apparatus as in claim 12, in which the filter fuel injector operates in response to first pressure, and said one valve of the diverter means is selectively operable to open in response to a pressure lower than the first pressure.

14. The apparatus as in claim 13, in which said valve is a spring loaded check valve.

15. The apparatus as in claim 14, in which a tapered rod is used to vary the opening pressure of said spring loaded check valve.

16. The apparatus as in claim 12, in which said trap has an inlet with a diverging interior entrance wall.

17. The apparatus as in claim 12, in which the supply of fuel contains tetraethyl lead whereby during fuel combustion in said combustion chambers an oxide is introduced to the exhaust gases which in turn coats particles to be trapped to facilitate ignition.

* * * * *